US008678079B2

(12) United States Patent
Clem et al.

(10) Patent No.: US 8,678,079 B2
(45) Date of Patent: Mar. 25, 2014

(54) FIXED SWIRL INDUCING BLAST LINER

(75) Inventors: Nicholas J. Clem, Houston, TX (US); Martin P. Coronado, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 840 days.

(21) Appl. No.: 12/134,975

(22) Filed: Jun. 6, 2008

(65) Prior Publication Data

US 2009/0301710 A1 Dec. 10, 2009

(51) Int. Cl.
*E21B 43/04* (2006.01)
*E21B 43/00* (2006.01)

(52) U.S. Cl.
USPC ..... 166/51; 166/222

(58) Field of Classification Search
USPC ..... 166/222, 242.1, 242.2, 276, 51, 278; 73/861.42; 137/813; 138/37
See application file for complete search history.

(56) References Cited

U.S. PATENT DOCUMENTS

| | | | | |
|---|---|---|---|---|
| 3,358,764 | A * | 12/1967 | Parker | 166/280.1 |
| 4,132,075 | A | 1/1979 | Fleck et al. | |
| 4,273,509 | A | 6/1981 | Erickson et al. | |
| 4,995,456 | A * | 2/1991 | Cornette et al. | 166/51 |
| 5,097,905 | A | 3/1992 | Goodwin | |
| 5,277,254 | A | 1/1994 | Rullman et al. | |
| 5,314,018 | A | 5/1994 | Cobb | |
| 5,636,691 | A | 6/1997 | Hendricson et al. | |
| 6,112,815 | A * | 9/2000 | Bøe et al. | 166/320 |
| 6,622,794 | B2 | 9/2003 | Zisk, Jr. | |
| 6,675,891 | B2 * | 1/2004 | Hailey et al. | 166/228 |
| 6,923,260 | B2 | 8/2005 | Coronado et al. | |
| 7,096,946 | B2 | 8/2006 | Jasser et al. | |
| 7,174,959 | B2 | 2/2007 | Pratt | |
| 7,185,704 | B2 | 3/2007 | Bigelow et al. | |
| 2006/0113089 | A1 * | 6/2006 | Henriksen et al. | 166/386 |

OTHER PUBLICATIONS

Vickery, Harold E., et al., "New One-Trip Multi-Zone Frac Pack System with Positive Positioning", SPE 78316; Oct. 1-8, 2002.
Bussear, Terry, et al., "Design and Qualification of a Remotely-Operated, Downhole Flow Control System for High-Rate Water Injection in Deepwater", SPE 88563, Oct. 1-8, 2004.
Clem, N.J., et al., "Utilizing Computational Fluid Dynamics (CFD) Analysis as a Design Tool in Frac-Packing Applications to Improve Erosion Life", SPE 102209, Sep. 1-5, 2006.

* cited by examiner

*Primary Examiner* — Kenneth L Thompson
*Assistant Examiner* — Michael Wills, III
(74) *Attorney, Agent, or Firm* — Steve Rosenblatt

(57) ABSTRACT

Wear is reduced in abrasive slurry service at an outlet into an annular space defined by the wellbore and around the tool. In a gravel packing application with a crossover, the slurry exits a central passage and goes into an internal annulus in the tool. Turning vanes that make at least one full turn and that have a height at least partially the height of the annular space are there to impart a swirl movement to at least a portion of the slurry stream. The swirling motion has beneficial effects of reducing turbulence which allows a velocity reduction for a comparable output volume.

20 Claims, 2 Drawing Sheets

FIXED SWIRL INDUCING BLAST LINER

FIELD OF THE INVENTION

The field of the inventions is slurry delivery devices for downhole use and more particularly features of such devices that resist wear and erosion at the delivery ports.

BACKGROUND OF THE INVENTION

Gravel packing and fracturing equipment involves moving a slurry flow from an internal flow bore through an internal annulus in the tool and ultimately out an exterior wall to an outer annulus usually around screens. Typically the tool that is used is a crossover that can take various positions for delivery of fracturing fluid and at another time delivery of gravel slurry with other positions that allow removal of excess fluid through circulation or reverse circulation.

The gravel slurry is fairly abrasive and when combined with the flow rates that can occur in the crossover tool it often results in high wear of parts that receive an impact from the fluid stream as it changes direction within the tool. One effort to address the erosion issue within the tool is to provide a sleeve after the first turn from a central flow path to an internal annulus. In U.S. Pat. No. 7,096,946 such a sleeve 80 is rotatably mounted to turn on its longitudinal axis and the flowing slurry stream interacts with internal vanes 66. The objective here was to extend the wear of sleeve 80 by rotating it so that the slurry impinged on a full circumference on the inside wall of sleeve 80 rather than a fixed spot.

Other efforts to protect slurry outlet ports have focused on aperture liners that are slightly smaller than the aperture itself. These liners could be in the form of a sacrificial sleeve or inserts as for example illustrated in U.S. Pat. No. 5,636,691. Crossover tool assemblies in general are illustrated in U.S. Pat. No. 6,923,260. Vanes outside of sand screens assemblies for evenly distributing gravel after release from the crossover is shown in U.S. Pat. No. 4,995,456.

Spiral vanes have been used downhole in separator service such as illustrated in item 304 in U.S. Pat. No. 7,174,959 and item 20d in U.S. Pat. No. 4,273,509. Spiral vanes 112 in U.S. Pat. No. 4,132,075 are used to promote mixing to improve heat transfer in a geothermal application where turbulence is sought as an improvement to heat transfer rates. Spiral vanes can be combined with a centralizer to promote distribution of pumped cement for an annular space around a tubular as disclosed in U.S. Pat. No. 5,097,905.

To address an erosion problem with slurry outlet ports in downhole equipment and more particularly in crossover tool systems that deliver fracturing fluids and gravel slurries, the present invention proposes a technique to improve flow dispersion and reduce turbulence in the tool so as to decrease the exit velocity of slurry from ports to a lower rate and consequently reduce the erosion effect. The result is accomplished by inducing a swirl in at least a portion of the flowing stream with the beneficial result being that void spaces in an internal tool annulus are minimized which results in an effective increase in flow area which in turn leads to less turbulence, better filling of the annular volume with a resulting reduction in velocity and longer useful life for the ultimate exit ports into a surrounding annulus such as around gravel pack screens. These and other advantages of the present invention will be more readily apparent to those skilled in the art from a review of the description of the preferred embodiment and associated drawings while recognizing that it is the claims that determine the full scope of the invention.

SUMMARY OF THE INVENTION

Wear is reduced in abrasive slurry service at an outlet into an annular space defined by the wellbore and around the tool. In a gravel packing application with a crossover, the slurry exits a central passage and goes into an internal annulus in the tool. Turning vanes that make at least one half turn and that have a height at least partially the height of the annular space are there to impart a swirl movement to at least a portion of the slurry stream. The swirling motion has beneficial effects of reducing turbulence which allows a velocity reduction for a comparable output volume. As a result of the lower turbulence leading to the final exit from the tool into the surrounding annulus, the exit ports experience reduced erosion and longer service life.

DETAILED DESCRIPTION OF THE PREFERRED EMBODIMENT

Figure 1:
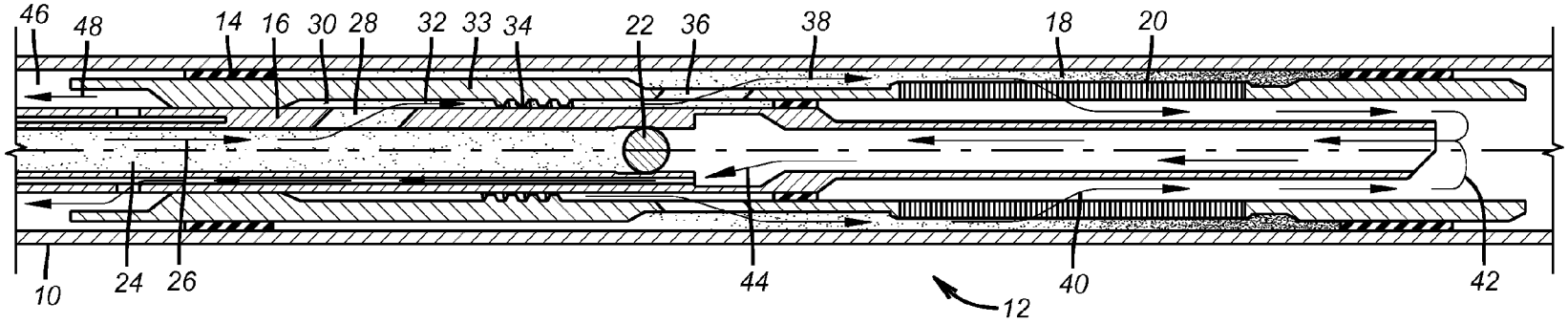
FIG. 1 is a section view of a gravel packing assembly showing the flow of slurry through it.

FIG. 1 shows casing 10 and a gravel packing assembly 12 located within. An external packer 14 is set against the casing 10. A crossover tool 16 is shown in a position for gravel deposition in annulus 18 around screens 20. A ball 22 has been dropped to a seated position blocking off passage 24. Arrow 26 represents slurry being pumped from the surface through passage 24. The flow exits through openings 28 into an inner annulus 30 defined by body 33 and crossover tool 16. Arrow 32 represents this flow. In annulus 30 vanes 34, best seen in detail in FIG. 3, impart a swirling motion to the slurry flow in annulus 30. The flow of slurry then exits ports 36 into annulus 18 as illustrated by arrow 38. The solids from the slurry remain in annulus 18 while the carrier fluid goes through screen 20 as represented by arrow 40. Flow continues as represented by arrows 42 and 44 to bypassing ball 22 to exit into annulus 46 above the packer 14 as indicated by arrow 48.

Figure 2:
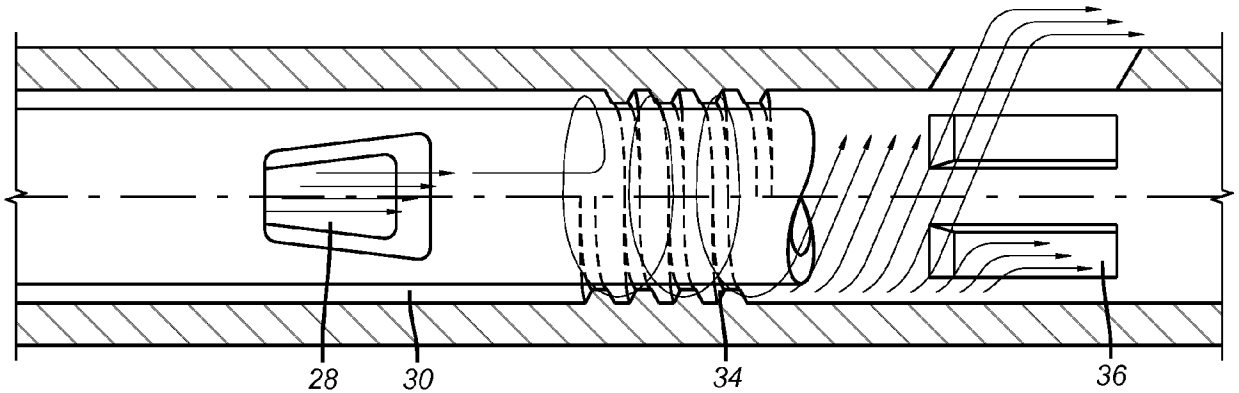
FIG. 2 shows a part of FIG. 1 in greater detail focusing in on the swirling action in the section with vanes.
Figure 3:
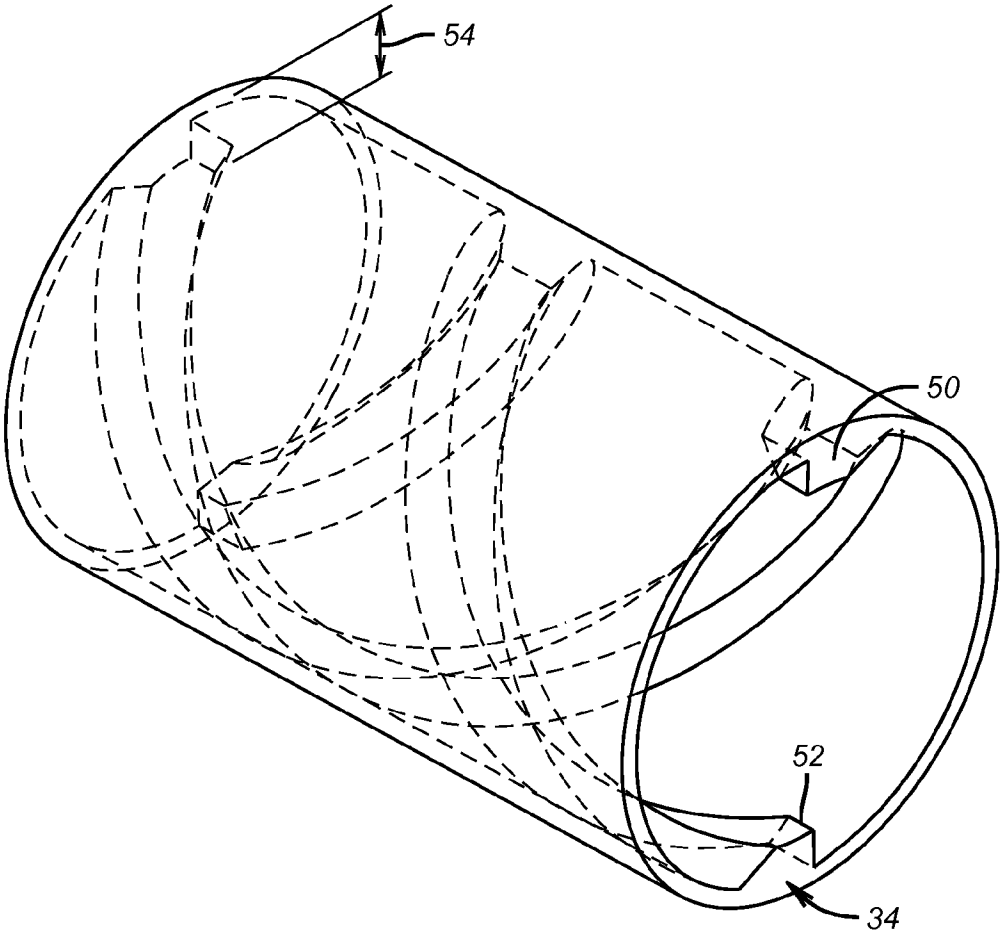
FIG. 3 is a perspective view of the vanes that impart the swirling action to the slurry flow.

Focusing now on what happens between ports 28 and 36 in annular space 30 as shown in more detail in FIGS. 2 and 3 the exiting flow from ports 28 has a spin imparted to at least a portion of the annular flow by the vanes referred to generally as 34. FIG. 3 shows two spirals 50 and 52 that are circumferentially 180 degrees apart. However, additional spirals can be used that are uniformly or differently spaced circumferentially. The spirals can track parallel to each other and the number of turns is preferred to be at least 180 degrees of revolution along the path of a single spiral. If the pitch of the spirals is the same what is created are flow paths of constant width as represented by the constant spacing between the spirals. The shape of a given spiral in cross-section can be square, rectangular, trapezoidal or a rounded shape such as semicircular or a partially elliptical shape. The height 54 that a spiral such as 50 extends into the annulus around which it circles can comprise the entire height of the annulus in which case all the incoming slurry flow will be subjected to a spin created by the spirals or the height can be shorter than the height of the annulus 30 in which case some of the flowing slurry steam will have a spin imparted to it while some passes the spirals without directly having a spin imparted to it. It depends on how much pressure drop is acceptable based on the capacity of the surface equipment delivering the slurry and returning the screened carrier fluid to the surface.

The benefit of using vanes such as 50 and 52 is that the flow characteristics are changed to a more dispersed and ultimately less turbulent flow which tends to eliminate or reduce voids and reduce the pressure required to circulate the slurry out through openings 36. The benefit comes as a velocity reduction of the slurry making an exit at ports 36 due to effectively increasing the flow area by dispersing the flow throughout the annulus. The result being less erosion that can limit the service life of the gravel packing equipment shown in FIG. 1.

This benefit is to be distinguished from the design in U.S. Pat. No. 7,096,946. There the vanes were very short along the spiral path because the sole purpose of the vanes was to impart a spin to the tube 80 so that the exiting slurry didn't hit the same spot constantly when emerging from a central flow passage. There was no consideration given to the erosion that could occur at the outlet below the spinning sleeve. The short length along a spiral path was such that no significant benefit from a turbulence or velocity reduction near the ultimate exit from the gravel pack assembly was envisioned or obtained.

While the vanes such as 50 and 52 are illustrated in slurry service they can also be adapted for use in high velocity fluid applications in liquid or gas service such as steam such as in injection applications in oil sands service. While the preferred embodiment is an application in an annular space, the vanes can also be used in flow lines or pipelines to reduce turbulence and increase throughput or required pumping power. The vanes such as 50 and 52 can be made of a hardened material or be externally coated with a hardened material to resist erosion from the slurry flowing past. The vanes can be mounted on a replaceable sleeve for rapid changing or they can be made integral to a wall that defines a flowpath where they are mounted.

The above description is illustrative of the preferred embodiment and many modifications may be made by those skilled in the art without departing from the invention whose scope is to be determined from the literal and equivalent scope of the claims below.

We claim:

1. An erosion reduction apparatus for a slurry flow path in a subterranean tool for substantial delivery of solids that are carried by a carrier fluid to an annular space around the subterranean tool, comprising:

a stationary body having a passage therein defined by a cylindrical wall surrounding the subterranean tool to define said annular space, said passage receiving a flowing slurry of solids carried by a carrier fluid at an inlet to said annular space and said slurry emerging from said annular space substantially unchanged, as to the solids and the carrier fluid, through an outlet from said annular space;

a plurality of stationary projections extending from said body inwardly at least in part into said passage within said body to change the direction of slurry flow away from a direction impinging said wall defining said passage and toward a spiral flow pattern that reduces wear due to a decreased impact force.

2. The apparatus of claim 1, wherein:

said projections extend circumferentially in said path at least 180 degrees.

3. The apparatus of claim 2, wherein:

said projections define at least one helical path.

4. The apparatus of claim 3, wherein:

said at least one helical path comprises a plurality of helical paths;

said helical paths have substantially constant widths.

5. The apparatus of claim 3, wherein:

said at least one helical path comprises a plurality of helical paths;

said helical paths have varying widths.

6. The apparatus of claim 2, wherein:

said projections extend only partially across said passage in a direction perpendicular to flow.

7. The apparatus of claim 6, wherein:

said projections define a bypass portion of the passage where flow is not directly affected by said projections because of their height.

8. The apparatus of claim 1, wherein:

said body comprises a port leading to an annulus that defines said passage;

said projections reducing erosion of said body from a slurry that flows through said annulus.

9. The apparatus of claim 1, wherein:

said projections comprise sloping sides and a flat top.

10. The apparatus of claim 1, wherein:

said projections in a plane transverse to their length comprise a curved shape.

11. The apparatus of claim 1, wherein:

said projections comprise a square or rectangular shape in cross-section.

12. An erosion reduction apparatus for a slurry flow path in a subterranean tool for substantial delivery of solids that are carried by a carrier fluid to an annular space around the subterranean tool, comprising:

a stationary body having a passage therein defined by a cylindrical wall, said passage receiving a flowing slurry of solids carried by a carrier fluid at an inlet to said passage and said slurry emerging substantially unchanged, as to the solids and the carrier fluid, through an outlet passage and into from said surrounding annular space;

a plurality of stationary projections extending from said body inwardly at least in part into said passage within said body to change the direction of slurry flow away from a direction impinging said wall defining said passage and toward a spiral flow pattern that reduces wear due to a decreased impact force;

said projections reduce turbulence of flow through said passage.

13. An erosion reduction apparatus for a slurry flow path in a downhole tool, comprising:

a stationary body having a passage therein defined by a cylindrical wall, said passage receiving a flowing slurry therethrough;

a plurality of stationary projections extending from said body inwardly at least in part into said passage within said body to change the direction of slurry flow away from a direction impinging said wall defining said passage and toward a spiral flow pattern that reduces wear due to a decreased impact force;

said body is a part of a crossover tool assembly further comprising a screen mounted below said body and said passage is within said crossover tool leading to an outlet above said screen.

14. The apparatus of claim 13, wherein:

said body further comprises an inlet to said passage with said projections disposed between said inlet and said outlet.

15. The apparatus of claim 14, wherein:

said projections extend circumferentially in said path at least 360 degrees.

16. The apparatus of claim 15, wherein:

said projections define at least one helical path.

17. The apparatus of claim 16, wherein:

said at least one helical path comprises a plurality of helical paths;

said helical paths have substantially constant widths.

18. The apparatus of claim 17, wherein:

said projections extend only partially across said passage in a direction perpendicular to flow.

19. The apparatus of claim 18, wherein:

said projections reducing erosion downstream in said crossover from a slurry that flows through said passage.

20. The apparatus of claim 19, wherein:

said projections reduce turbulence of flow through said passage.

* * * * *